United States Patent [19]

Tsals et al.

[11] Patent Number: 4,559,661

[45] Date of Patent: Dec. 24, 1985

[54] PAINT SCRAPER

[75] Inventors: Izrail Tsals, Princeton Junction, N.J.; Gerald E. Peterson, St. Paul, Minn.; Rudy R. Karliner, Minnetonka, Minn.; Scott R. Carpenter, Arden Hills, Minn.; Peter L. Frank, Corcoran, Minn.

[73] Assignee: Wagner Spray Tech Corporation, Minneapolis, Minn.

[21] Appl. No.: 747,378

[22] Filed: Jun. 21, 1985

Related U.S. Application Data

[63] Continuation-in-part of Ser. No. 522,975, Aug. 15, 1983, abandoned.

[51] Int. Cl.[4] ..... B44D 3/16

[52] U.S. Cl. ..... 15/93 R; 30/272 A; 299/37

[58] Field of Search ..... 15/22 R, 22 A, 93 R; 51/170 TL; 30/169, 272 R, 272 A; 29/81 G; 310/15, 17, 27, 30, 34; 299/37

[56] References Cited

U.S. PATENT DOCUMENTS

| | | | |
|---|---|---|---|
| 1,390,702 | 9/1921 | Hammond . | |
| 1,992,770 | 2/1935 | Rathbun | 15/22 R X |
| 2,196,667 | 4/1940 | Moseley | 15/22 R |
| 2,503,539 | 4/1950 | Aspeek | 15/93 R |
| 2,859,676 | 11/1958 | Pottol et al. | 30/272 R |
| 2,876,537 | 3/1959 | Bates | 30/171 |
| 2,938,269 | 5/1960 | Nissen | 30/272 R |
| 2,958,355 | 11/1960 | Young | 30/272 R |
| 3,147,548 | 9/1964 | Aspeek | 30/272 |
| 3,147,549 | 9/1964 | Aspeek | 30/272 R |
| 3,316,636 | 5/1967 | Raper, Jr. et al. | 30/272 A |
| 3,317,764 | 5/1967 | Dremel | 310/17 |
| 3,530,577 | 9/1970 | Franklin et al. | 30/169 |
| 3,555,678 | 1/1971 | Agulnick et al. | 30/166 |
| 3,596,118 | 7/1971 | Davis | 310/17 |
| 3,629,893 | 12/1971 | Brown | 15/103 |
| 3,845,553 | 11/1974 | Fields | 30/272 A |
| 4,182,000 | 1/1980 | Fairbairn | 30/169 X |
| 4,286,383 | 9/1981 | Farden | 30/169 |

FOREIGN PATENT DOCUMENTS

| | | | |
|---|---|---|---|
| 305024 | 7/1971 | U.S.S.R. | 15/93 R |
| 424677 | 1/1975 | U.S.S.R. | 30/169 |

*Primary Examiner*—Edward L. Roberts

*Attorney, Agent, or Firm*—Hill, Van Santen, Steadman & Simpson

[57] ABSTRACT

A manually operable power unit for paint scraping and the like comprising a casing with a longitudinal axis having a handle to enable portable use by the operator, an electro-magnetic motor mounted within the casing including a stator and an armature mounted relative to the stator for movement parallel to the longitudinal axis, a bladeholder connected to the armature reciprocally movable in unison together, the bladeholder extending generally parallel to the longitudinal axis of the casing and the direction of movement of of the reciprocating armature to provide contemporaneous colinear movement of the bladeholder and the armature to substantially eliminate bending forces on the bladeholder imposed by the electromagnetic drive forces of the motor, the motor being operable on energization to move the armature and the bladeholder from a starting position to an extended position, and a spring connected to the bladeholder which is compressed when the bladeholder is moved to its extended position and the spring operating to move the bladeholder to its starting position upon release of the electromagnetic forces generated by the motor.

39 Claims, 15 Drawing Figures

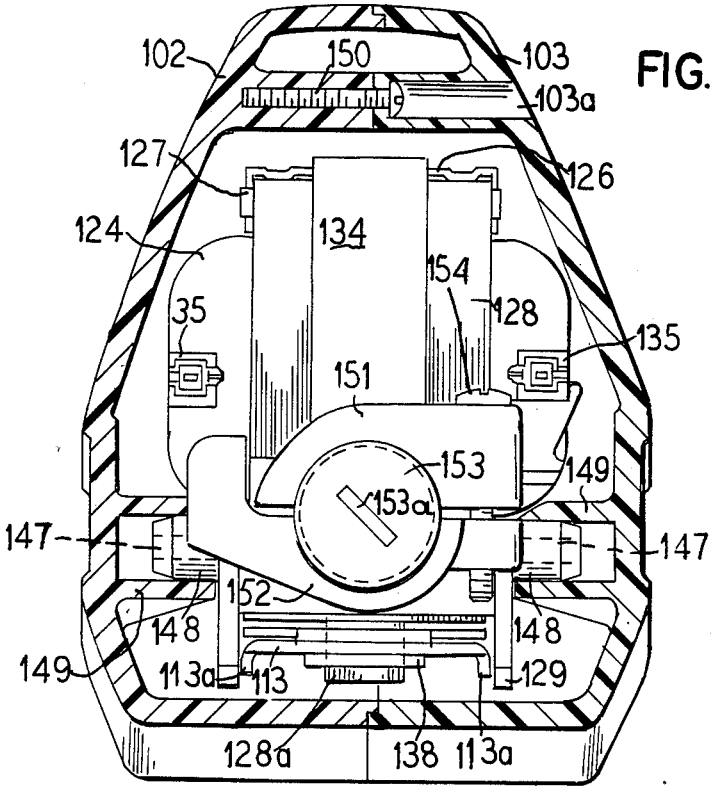
FIG. 10
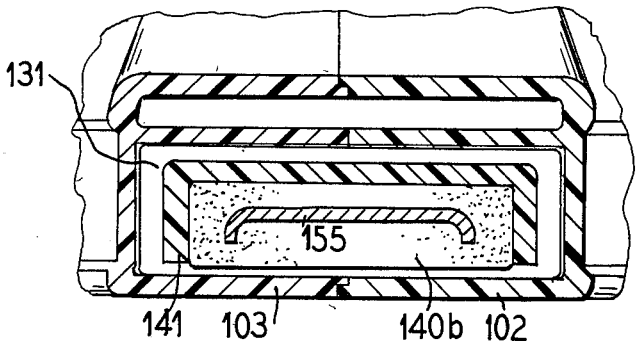
FIG. 14
FIG. 15
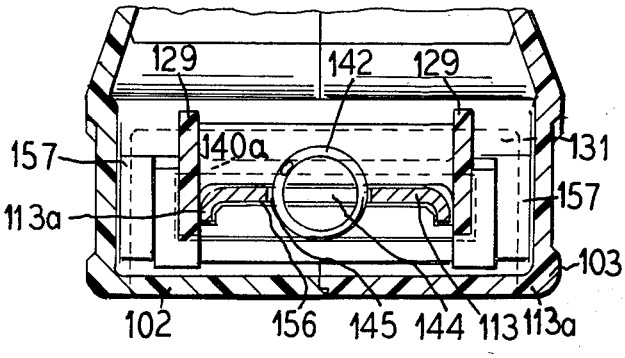

PAINT SCRAPER

This is a continuation-in-part of application Ser. No. 522,975, filed Aug. 15, 1983, now abandoned.

FIELD OF THE INVENTION

The present invention relates generally to a power unit for a paint scraper and more particularly to a lightweight hand operated paint scraper that is portable and can be readily moved from job to job by an operator.

THE PRIOR ART

Devices employing electromagnetic motors for oscillating or reciprocating a blade-like element are known in the art. U.S. Pat. No. 2,938,269, for example, employs an electromagnetic motor for oscillating a knife blade. A vibrating tool is disclosed in U.S. Pat. No. 3,530,557 wherein the axis of the motor is at right angles to the direction of reciprocation of a blade operated by the motor. An electric culinary device is described in U.S. Pat. No. 3,555,678 having a knife blade positioned at one side of a motor. An electric tool for vibrating an etching rod is disclosed in U.S. Pat. No. 3,596,118. An oscillating sander is described in U.S. Pat. No. 4,182,000 having a power driven platen which reciprocates at an underside of the unit.

A problem in the design and construction of such units is the competing goals of maintaining the weight of the unit at a magageable level, while making the unit sufficiently powerful to effectively remove paint which may comprise several layers on a painted surface. While a heavier blade is desirable for the latter purpose, the more massive a blade becomes, the greater its inertia, and thus more power is required to change the direction of movement of the blade during reciprocation. This may require, for example, a larger motor, making th overall unit heavier. Another problem in the design of such units is the unavoidable use of the units in dusty environments. The housing for such units must have an opening through which the blade extends; in conventional units this opening, being in close proximity to the working blade, affords a means for dust and dirt to enter the housing and to coat the internal moving components. A further problem in the design and construction of said units is to minimize the transfer of vibrating forces to the user.

SUMMARY OF THE INVENTION

The present invention concerns a new and improved manually operable power unit for paint scraping and the like and more particularly to a power unit with a bladeholder extending forwardly of the unit with a scraping blade clamped to its outer end. More particularly, the present invention concerns a power unit with a bladeholder that is mounted generally coaxially with the longitudinal axis of a housing and the direction of movement of a reciprocating armature to provide contemporaneous colinear movement of the bladeholder and the armature to substantially eliminate bending forces on the bladeholder imposed by the electro-magnetic drive forces. This arrangement has been found to be superior to other ways of positioning the bladeholder relative to the armature such as where the bladeholder is positioned in an offset relationship relative to the armature. In one embodiment the bladeholder and the armature are disposed in generally coaxial relation to provide contemporaneous colinear movement of the bladeholder and the armature, lighter weight less costly components can be used with generally the same effectiveness as heavier weight components while at the same time providing a lighter weight tool for manual use. In another embodiment, the armature and bladeholder are pivotally connected, but the bladeholder still moves in a direction parallel to the armature movement.

It is an important object of the present invention to provide a new and improved manually operable motorized paint scraper of lighter weight and where the components can be economically manufactured.

Yet another object of this invention is to provide a new and improved electro-magnetic motor construction in combination with a bladeholder whereby the armature and the bladeholder are mechanically tied and movable in unitary coaxial and colinear relation to minimize bending forces on the bladeholder.

Yet another object of this invention is to provide a new and improved stator and armature construction for actuating a bladeholder in colinear unison with the armature.

According to other features of the invention, in one embodiment a manually operable power unit for paint scraping and the like has a casing having a handle to enable portable use by an operator, an electro-magnetic motor mounted within the casing including a C-shaped stator and an armature coaxially mounted relative to the C-shaped stator, a bladeholder connected to the armature reciprocally movable in unison together, means for mounting the bladeholder generally coaxially of the longitudinal axis of the reciprocating armature to provide contemporaneous colinear movement of the bladeholder and the armature to substantially elminate bending forces on the bladeholder imposed by the electromagnetic drive forces of the motor, the motor being operable on energization to move the armature and the bladeholder from a starting position to an extended position, and spring means connected to the bladeholder which is compressed when the bladeholder is moved to its extended position and the spring means operating to move the bladeholder to its starting position upon release of the electro-magnetic forces generated by the motor.

According to further features of the invention a stator having a stator cavity is provided having converging opposed stator surfaces defining a 30° chamfer angle at the opening defined thereby, and with the armature being wedge shaped and having converging armature surfaces positioned for parallel engagement with the converging opposed stator surfaces.

Still other features of the invention concern an electro-magnetic motor having a C-shaped stator and an armature coaxially mounted relative to the C-shaped stator, the C-shaped stator a series of parallel stator laminations aligned front to back of the L-shaped stator.

In a further embodiment, the armature is mounted at a pivot to the stator and moves in a direction parallel to the longitudinal axis of the housing, the armature is pivotally connected to the bladeholder, which is in turn also reciprocated parallel to the longitudinal axis.

The power scraper has a U-shaped bladeholder received in a correspondingly shaped channel in a bladeholder frame. The bladeholder frame is mounted in the housing by means of two rods extending transversely to the direction of reciprocation of the blade and bladeholder. Additionally the housing has a rubber grip for grasping by the user which further insulates the user from such vibrating forces.

The front opening in the housing through which the bladeholder extends and reciprocates has a pair of adjacent felt washers disposed immediately in the interior of the housing behind the opening, the felt washers having U-shaped openings through which the bladeholder extends. The felt washers permit the bladeholder to easily reciprocate therethrough at a high speed, but do not permit dust and other foreign material to enter the housing.

The bladeholder has a mass-reduction cutout therein so as to reduce the inertia thereof such that a powerful scraping motion is achieved but a relatively lightweight motor can be used to power the unit.

The unit further has a stroke adjustment means disposed at a rear of the unit for limiting the movement of the armature, and thus in turn limiting reciprocating movement of the bladeholder.

Other objects and features of the invention will more fully become apparent after a detailed study is given to the drawings and after consideration is given to the following detailed description.

DESCRIPTION OF THE DRAWINGS

In the accompanying sheets of drawings which form a part of this specification, the invention is illustrated as follows:

FIG. 10 is a sectional view of the power scraper shown in FIG. 9 taken along line X—X.

FIG. 14 is a sectional view of the assembly shown in FIG. 12 taken along line XIV—XIV.

FIG. 15 is a sectional view of the assembly shown in FIG. 12 taken along line XV—XV.

DESCRIPTION OF THE PREFERRED EMBODIMENTS

Figure 2:
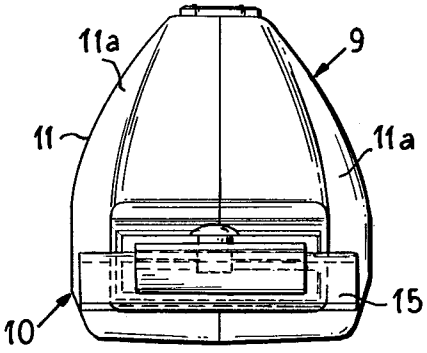
FIG. 2 is a front elevation of the paint scraper shown in FIG. 1.
Figure 1:
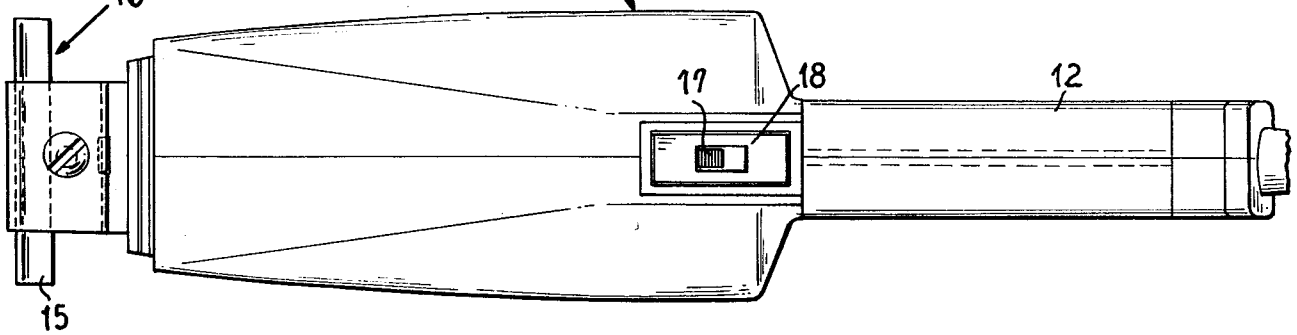
FIG. 1 is a top plan view of a first embodiment of a paint scraper constructed in accordance with the principles of the present invention.

The reference numeral 9 indicates generally a power unit for paint scraping. When a scraper blade is mounted on the power unit 9, a power paint scraper 10 is then identified. The reference numeral 11 indicates a paint scraper housing which has a handle 12 at its rear end and having a rear-to-front longitudinal axis. An electro-magnetic motor 13 of the so-called linear type is housed in the housing 11 for reciprocating a paint scraper blade 15.

Figure 3:
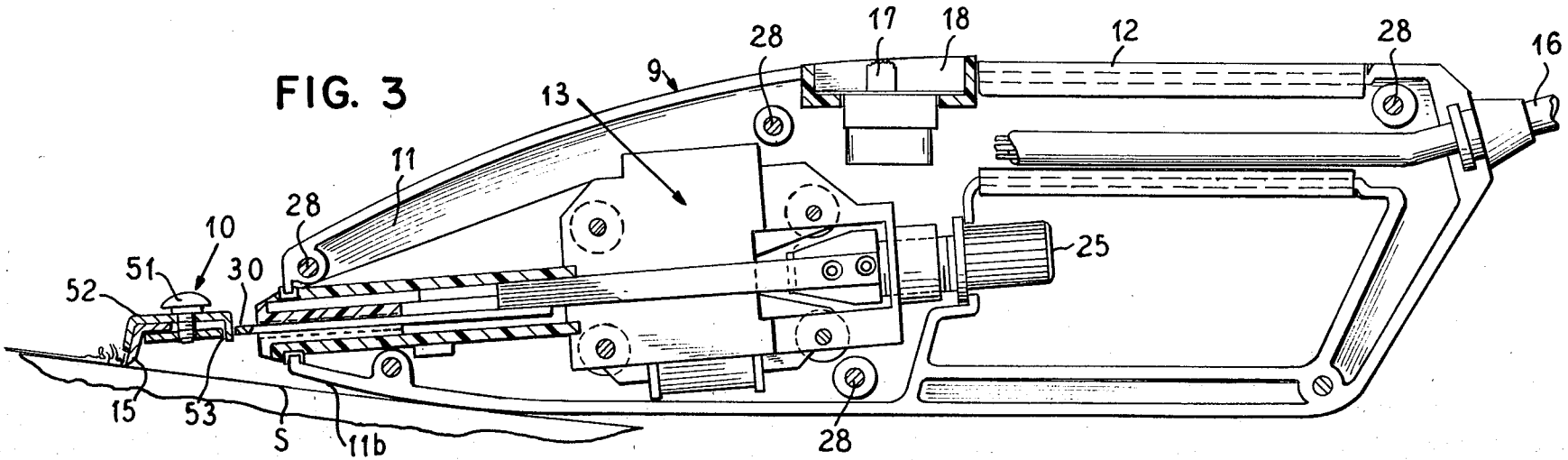
FIG. 3 is a longitudinal section of the paint scraper shown in FIG. 1 and with parts being shown in section and in elevation.

The motor 13 is electrically connected by means of an electric cord 16 to an electrical outlet (not shown) in a conventional manner. The wiring for the cord 16 is conventionally attached to the motor 13 and a push button ON-OFF switch 17 is mounted on a top side of the housing 11 in a switch housing recess 18 (FIG. 3). The switch 17 is suitably connected in the electric circut in any suitable manner and is only diagramatically illustrated. The switch 17 is provided to permit the operator to turn the motor 13 on and off as desired.

Figure 4:
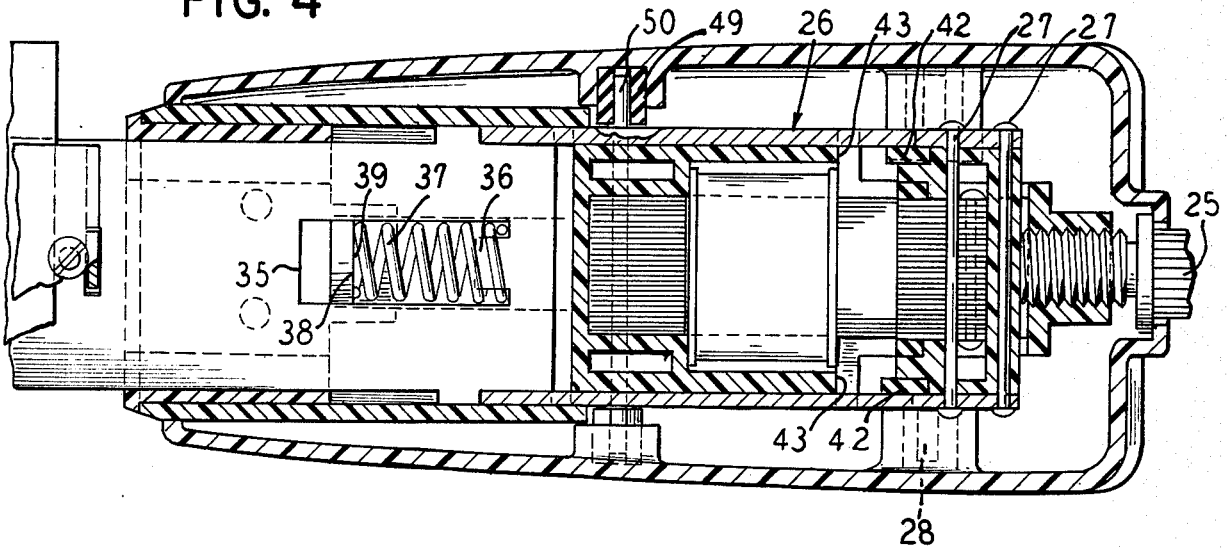
FIG. 4 is an enlarged fragmentary plan view, partly in section of the electro-magnetic motor and certain other internal components of the first embodiment of paint scraper constructed according to the principles of the present invention.
Figure 5:
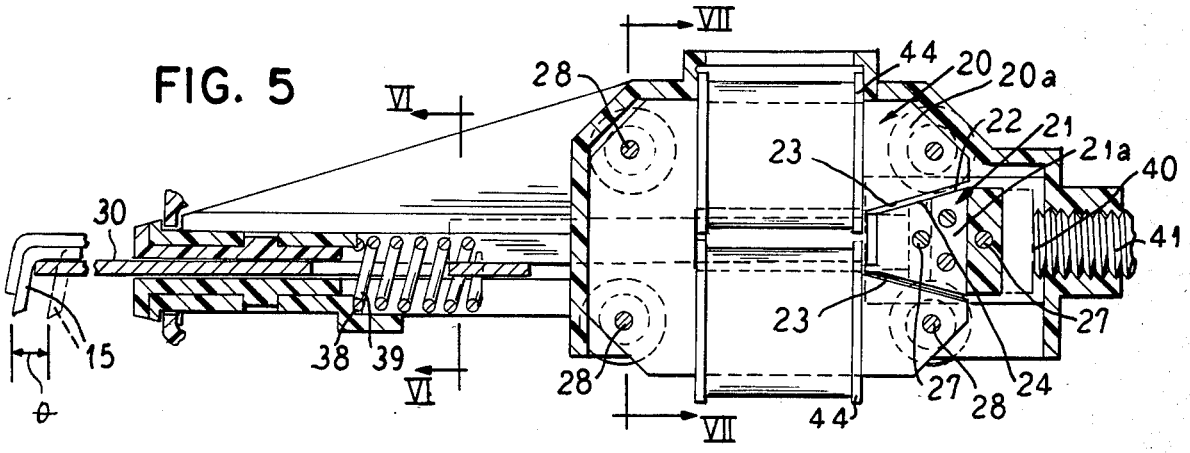
FIG. 5 is a side elevation, partly in section, of the electro-magnetic motor, the bladeholder and certain other components of the paint scraper of the previous figures.

The electro-magnetic motor 13 is mounted within the casing 11 and includes a C-shaped stator 20 and an armature 21. The stator and the armature are mounted in coaxial relationship as shown in FIGS. 4 and 5. The stator 20 is comprised of a stacked series of C-shaped laminations or plates **20*a* and the armature is comprised of a series of stacked wedge shaped plates 21*a*. In accordance with features of the invention, the C-shaped stator 20 defined a stator opening 22. This stator opening is more particularly defined by converging axially extending stator plate edges 23 (FIG. 5). The armature has its plates 21*a* also provided with converging axially extending opposed surfaces 24—24. The armature edges 24 on one side of the armature are parallel with the confronting edges 23 of the stator and the armature edges 24 on the opposite side thereof are disposed in parallel relationship with the stator edges 23. The stator and armature edges 23—23 and 24—24 all define a 30° chamfer angle at the opening 22. When the motor is energized the coils produce a magnetic flux in the laminations of the stator and cause the armature 21 to be moved axially into the opening 22 thus causing the scraper blade 15 to be moved from the dotted line position to the full line position as seen in FIG. 5. As seen in FIG. 5, the extent of the scraper stroke is approximately $\frac{1}{8}$". The distance of the stroke can be varied by rotating the hand operated adjustment knob 25 as seen in FIG. 4**, which operation will be discussed in further detail at another point in this specification.

Figure 6:
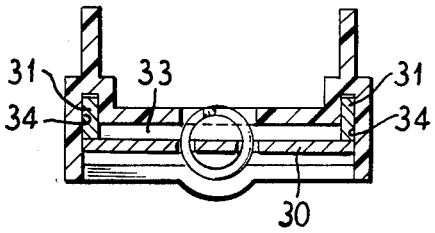
FIG. 6 is an enlarged cross-sectional view taken substantially on the line VI—VI looking in the direction indicated by the arrows as seen in FIG. 5.

In FIG. 4, it will be seen that the reference numeral 26 indicates a motor housing and fasteners 28 are provided to secure the stator to the sides of the casing. Additional fasteners 28—28 (FIG. 5) are provided to secure the plastic shell halves of the outer casing 11 in assembly with the motor housing 26. The same fasteners also project through the handle as seen in FIG. 3 to secure the halves of the outer casing 11 in assembly together. In FIG. 2, it will be seen that the casing 11 is comprised of a pair of molded shell halves **11*a*—11*a* which can be readily assembled and disassembled with respect to the motor assembly 13. These shell halves 11*a*—11*a* are provided with curved bottom surfaces as indicated at 11*b* to enable the operator of the scraper 10 to rest the scraper on a supporting surface S so that as the scraping operation occurs it is not necessary for the operator to hold the scraper 10 in spaced overlying relationship with respect to the surface being scraped according to features of the invention. Mounted in colinear relation to the armature 21 is bladeholder 30. As seen in FIG. 6, the bladeholder has a pair of arms 31—31 which are directly connected to the armature by means of the rivets 27—27. Thus, as the armature moves into and out of the opening 22 the movement of the bladeholder is directly responsive to the armature movement. In order to assist in the guided movement of the bladeholder 30 a nylon guide 33 is provided (FIG. 6). Also, the arms 31—31 of the bladeholder 30 are positioned within guide slots 34—34 in the drive housing (FIG. 6). The bladeholder 30 has a slot 35 provided therein and a tongue extends into the slot at one end thereof, the tongue being indicated at 36. A compression spring 37 is aligned with the tongue 36 and the tongue extends esentially of the coiled spring to provide a locating means to position the spring and the bladeholder in relation to one another. The opposite end of the spring at 38 is abutted against a fixed stop 39 which comprises part of the drive housing (FIG. 5). Thus, as the compression spring is compressed when the motor is energized, upon deenergization of the motor, the compressed spring is then released and causes the armature 21 to return to its disengaged position as shown by the dotted and full lines in FIG. 5. More specifically, when the armature 21 moves to its disengaged position it engages against end 40 of the adjustment screw 41 which in turn is connected to the adjustment nut 25. Thus, as the nut 25 is turned the position of the screw 41 can be varied to adjust its end 40 relative to the armature and thus vary the stroke of the blade 15**.

In order to stop the movement of the armature 21 in the forward direction, a series of rubber bumpers 42—42 (FIG. 4) are provided to limit the movement of the armature. As will further be seen in FIG. 2, the bumpers 42—42 are carried on the armature and are adapted to engage against the stops 43—43 which are part of the drive housing.

As seen in FIG. 5, it will further be noted that stator windings 44—44 are carried upon the legs of the C-shaped stator laminations.

Figure 7:
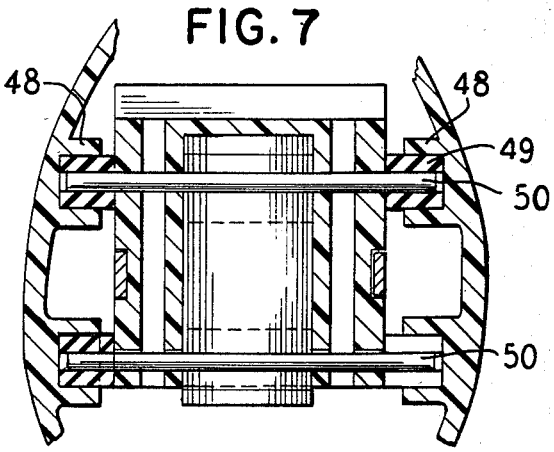
FIG. 7 is an enlarged fragmentary cross-sectional view taken on the line VII—VII looking in the direction indicated by the arrows as seen in FIG. 5.

Referring now to FIG. 7 and the casing 11, the casing 11 is provided with molded cushion holders 48 carrying cushions 49 and support pins 50 span the power unit and are engaged at opposite ends therewith. These cushions or sleeves 49 dampen the vibrations produced in the drive mechanism during operation.

With the normal 110 volt circuit, the electro-magnetic motor would operate at 60 cycles per second or 3600 cycles per minute thus enabling the scraper blade to generate a rapid scraping action.

The blade 15 can be readily removed and replaced after it has become worn out. To this end, the clamping screw 51 can be removed and a new blade 15 can be inserted and rested upon the outer end of the bladeholder 30. The screw can then be realigned in place through U-shaped clamp plate 52. The clamp plate 52 has an end which projects through a slot 53 provided in the outer end of the bladeholder 30 thus locking the U-shaped clamp plate in position on the bladeholder. When the screw 51 is turned into position it serves to tightly secure and clamp the scraper blade 15 between the bladeholder and the clamp plate 52.

Figure 8:
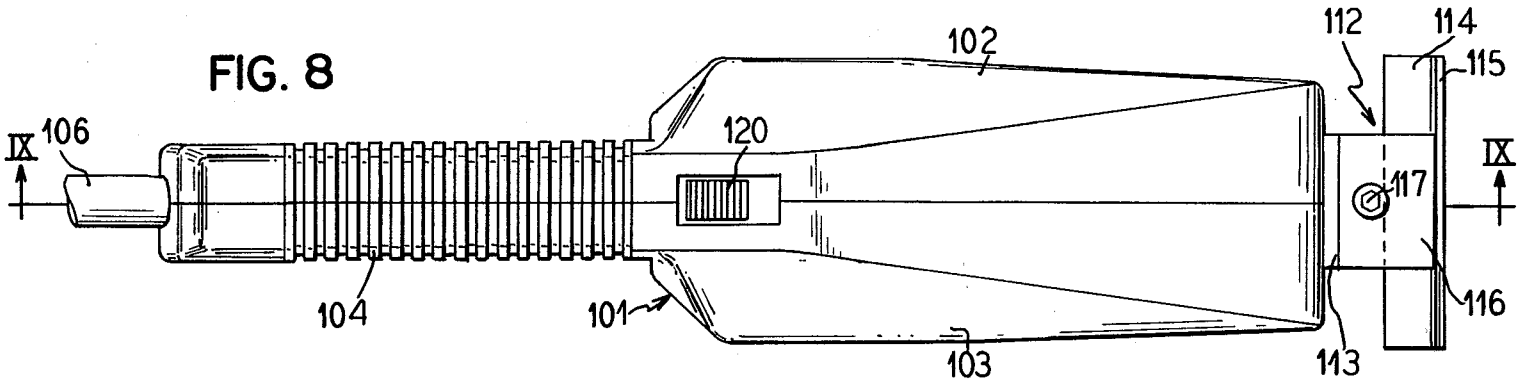
FIG. 8 is a top plan view of a further embodiment of a hand-held power scraper constructed in accordance with the principles of the present invention.
Figure 9:
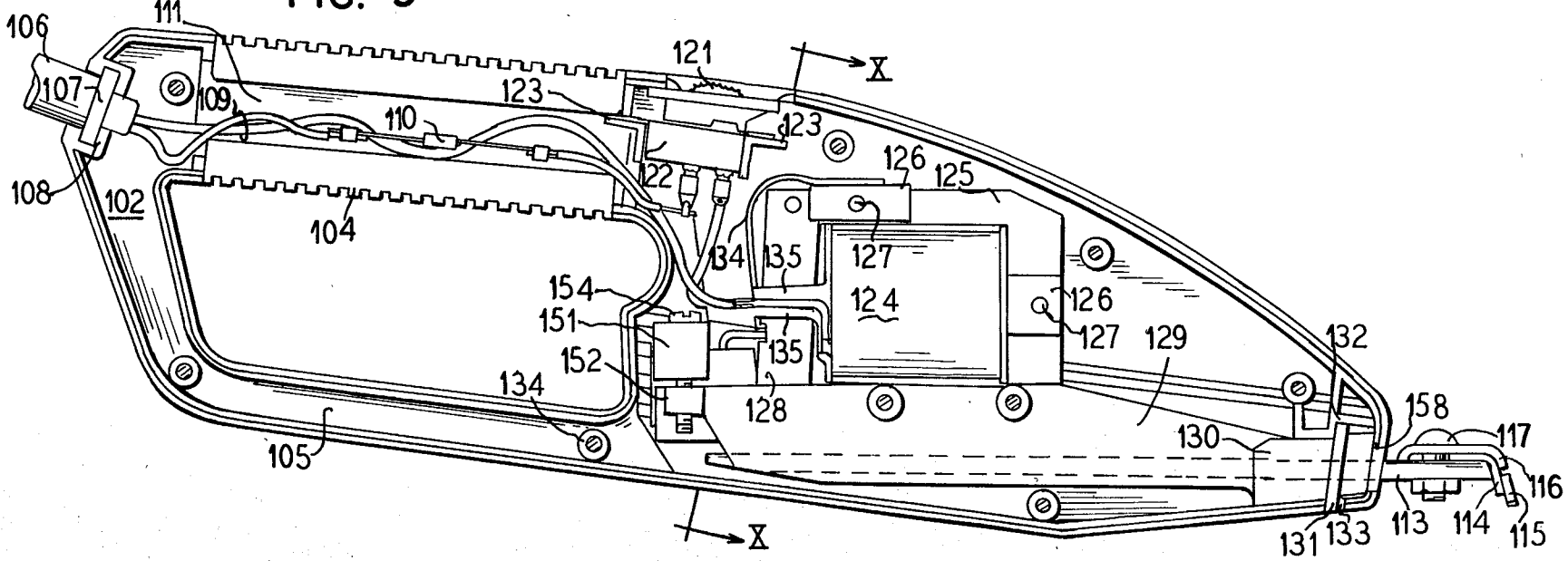
FIG. 9 is a sectional view of the power scraper shown in FIG. 8 taken along line IX—IX.

A further embodiment of a hand-held power scraper constructed in accordance with the principles of the present invention is shown in FIG. 8. The scraper 101 has a housing consisting of two housing shells 102 and 103 which are joined together to form a closed housing having a rear-to-front longitudinal axis. The scraper 101 has a handle 104 comprised of shock absorbing material, such as rubber, which surrounds an upper portion of each of the shells 102 and 103, as best seen in FIG. 9. Each shell 102 and 103 further has a guard connecting element 105 disposed generally opposite the handle 104 so as to provide an opening for gripping by a user. As also shown in FIG. 9, each shell (only the shell 102 being shown in FIG. 9) has a receptacle 108 for receiving a flanged grommet 107 connected to an electrical power cord 106. Electrical leads 109 extend for the grommet 107 and are conducted to a switch assembly 112 and terminals 135 of an electromagnetic motor coil 124. The switch assembly 112 has an exterior thumb switch 120 for turning the scraper on and off. A diode 110 may be interconnected with the leads 109. The details of the electrical connection form no part of the invention claimed herein and are of the standard type, and therefore need not be described in greater detail.

Figures 11, 12, 13:
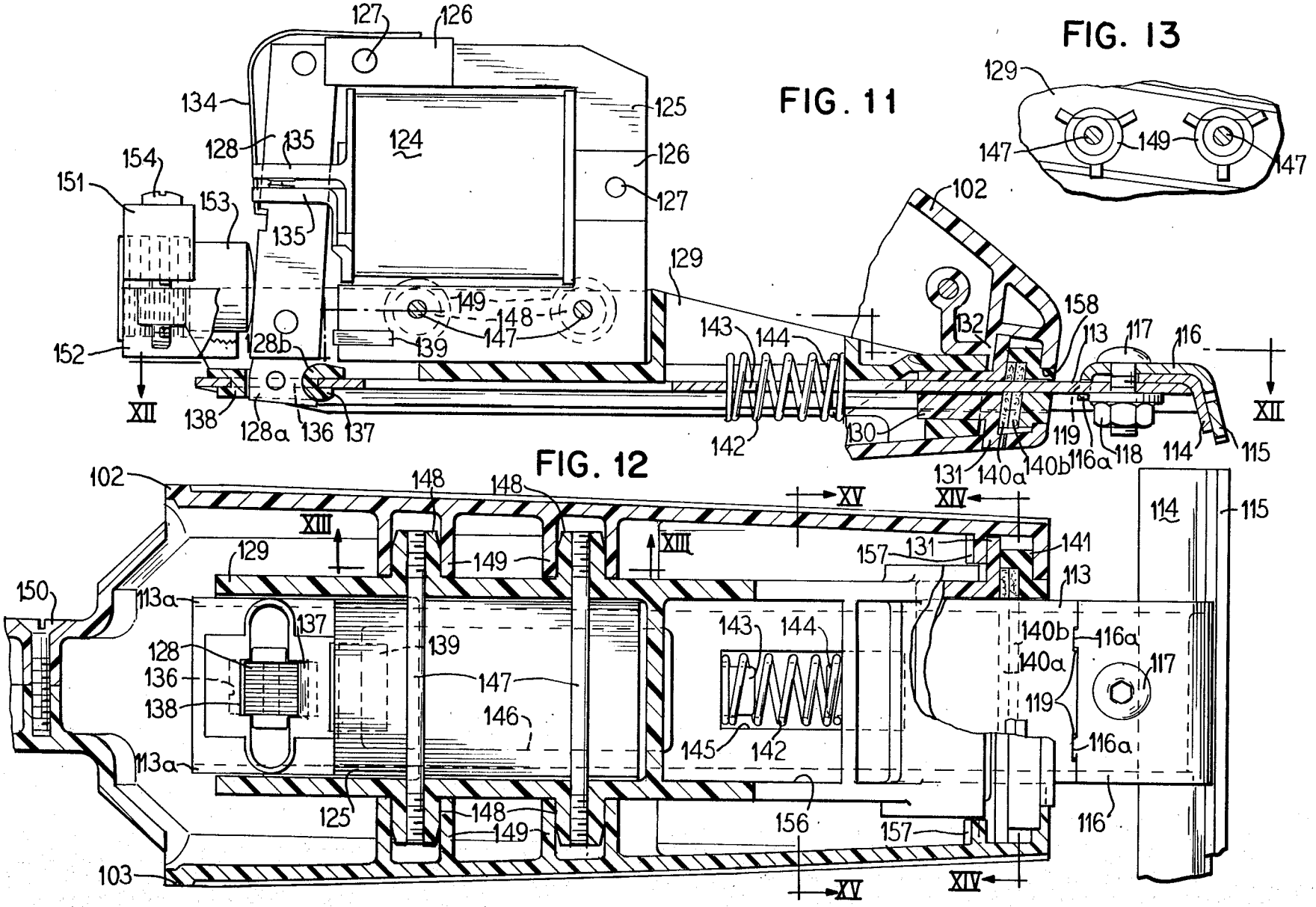
FIG. 11 is a side view, showing a portion of the housing, of the motor and drive assembly for the power scraper constructed in accordance with the principles of the present invention.
FIG. 12 is a sectional view of the assembly shown in FIG. 11 taken along line XII—XII, showing further details of the housing.
FIG. 13 is a sectional view of a portion of the assembly shown in FIG. 12 taken along line XIII—XIII.

The scraper 101 has a blade assembly 112 including a bladeholder 113 which extends longitudinally into the housing formed by the shells 102 and 103. An exterior portion of the bladeholder 113 supports a blade carrier 114 with a blade 115 attached thereto. The carrier 114 is clamped to the bladeholder 113 by a bolt 117 tightened with a nut 118. As shown in FIGS. 11 and 12, the clamp 116 has a pair of curved tabs **116*a* which are received in openings 119 in the bladeholder 113. The tabs 116*a* operating in combination with the curved opposite ends of the carrier 114, rigidly fix the position of the carrier 114, and thus of the blade 115 when the nut 118** is tightened.

The bladeholder 113, as best shown in FIG. 15, has a flattened U-shaped cross section, having two downwardly depending side flanges **113*a*. The bladeholder 113 slides in a correspondingly shaped channel 156 in a frame 129. The frame 129 additionally supports the motor coil 124 and a motor stator 125 which is comprised of a plurality of adjacent laminations, as shown in FIG. 12. The laminations of the stator 125 are held together by a bracket 126 and a suitable fastener 127. Another bracket 126 also functions to hold the laminations of the stator 125 together with a suitable fastener 127, and additionally has a leaf spring 134 connected thereto. The free end of the spring 134 is forced against an armature 128 pivotally connected at the bracket 126. As shown in FIGS. 11 and 12, the armature 128 has a free end 128*a* which extends through an opening 136 in a rear of the bladeholder 113 and is moved substantially parallel to the housing longitudinal axis. The free end 128*a* of the armature 128 has a curved surface 128*b* which receives a similarly curved bearing 137 which covers a front edge of the opening 136. The bearing 137 is comprised of slightly resilient material. The rear edge of the opening 136 is covered by a generally rectangular cover 138 the rear edge of the free end of the armature is slightly curved. The curved surface 128*b* and the rear edge curvature cooperate with the dimensions of the opening 136 to provide a pivotable lock of the armature 128 to the bladeholder 113** preventing vertical withdrawal of the armature and the supporting bladeholder.

The bladeholder 113 has an opening 145 therein in which a coil spring 142 is mounted. The spring 142 has a tab 143 connected to the bladeholder 113 extending into one end thereof, and a tab 144 connected to the frame 129 extending into the opposite end thereof. The coil spring 142 opposes forward motion of the bladeholder 113 (and the blade 115 attached thereto) and thus urges the bladeholder 113 rearward after the bladeholder 113 is moved forward by actuation of the armature 128. The combined action of the armature 128 and the spring 142 thus impart a rapid reciprocal movement to the bladeholder 113 and the blade 115.

The bladeholder 113 has an additional opening 146 therein for reducing the mass thereof, thereby reducing the inertia of the bladeholder and permitting the use of a relatively lightweight motor to operate the scraper.

The frame 129 is connected to each of the housing shells 102 and 103 by a pair of parallel rods 147 extending transversely to the direction of reciprocation of the bladeholder 113. The rods 147 are pressed into bosses 148 of the frame 129 which are in turn received in receptacles 149.

The housing shells 102 and 103, when joined, form a front opening 158 in the scraper 101 through which the bladeholder 113 extends. As shown in detail in FIGS. 11, 12, 14 and 15, a first bearing element 130 having a flange 131 extending generally perpendicular to the bladeholder 113 is received in a shoulder assembly 132 in each of the housing shells 102 and 103, and a receptacle 133 at a bottom thereof. The flange 131 abuts a first of two adjacent felt washers **140*a* and 140*b*, which are further retained by a second bearing element 141, which also extends into the opening 158. The flange 131 of the first bearing element 130, and a second bearing element 141, with the felt washers 140*a* and 140*b* held therebetween, are retained within the housing by press fit between a front of the shells 102 and 103 and projections 157 extending toward an interior of the housing from each of the shells 102 and 103. Each of the first and second bearing elements 130 and 131, and the felt washers 140*a* and 140*b* has a U-shaped channel for accommodating the bladeholder 113**.

The shell 102 has a plurality of bosses 134 (only one of which is numbered in FIG. 9 for purpose of clarity) for receiving suitable fasteners 150 for holding the shells together. The fasteners 150 are the only mechanical fasteners utilized in the entire scraper, all other parts being held in the interior thereof by press fit when the shells 102 and 103 are joined together.

The scraper 101 is provided with a stroke adjustment means at a rear of the armature 128. The stroke adjustment means includes an upper clamp 151 and a lower clamp 152 which receive a threaded bumper 153 therebetween. The bumper 153 has a screwdriver slot **153*a* for adjusting the axial position thereof. After the axial position of the bumper 153 has been adjusted, the clamps 151 and 152 are tightened by a bolt 154. The armature 128 directly abuts the bumper 153 as the bladeholder 113 is moved rearwardly by the action of the spring 142, thus limiting the stroke thereof. A forward bumper 139 mounted in the frame 129 limits the forward movement of the armature 128**.

Although modifications and changes may be suggested by those skilled in the art, it is the intention of the inventors to embody within the patent warranted hereon all changes and modifications as reasonably and properly come within the scope of their contribution to the art.

We claim:

1. A manually operable power unit for paint scraping and the like comprising a casing having a handle to enable portable use by an operator, an electro-magnetic motor mounted within the casing including a C-shaped stator and an armature coaxially mounted relative to said C-shaped stator, a bladeholder connected to said armature reciprocally movable in unison together, means for mounting the bladeholder generally coaxially of the longitudinal axis of the reciprocating armature to provide contemporaneous colinear movement of the bladeholder and the armature to substantially eliminate bending forces on the bladeholder imposed by the electromagnetic drive forces of the motor, the motor being operable on energization to move the armature and the bladeholder from a starting position to an extended position, and spring means connected to the bladeholder which is compressed when the bladeholder is moved to its extended position and said spring means operating to move the bladeholder to its starting position upon release of the electromagnetic forces generated by the motor.

2. The power unit of claim 1 further characterized by the C-shaped stator defining a stator cavity and with the armature axially movable into and out of the cavity and cooperable with said spring means for reciprocating said bladeholder.

3. The power unit of claim 2 further characterized by the stator cavity having converging opposed stator surfaces and with said armature being wedge shaped and having converging armature surfaces positioned for parallel engagement with said converging opposed stator surfaces.

4. The power unit of claim 1 further characterized by the bladeholder having an L-shaped scraping blade at its outer end and clamp means for securing the blade in assembly with said bladeholder.

5. The power unit of claim 1 further characterized by a hand operated adjustment means connected to said bladeholder and positioned at a rear end of the casing and extending externally thereof and operable upon rotative movement to vary the rearward extent of movement of the bladeholder.

6. The power unit of claim 1 further characterized by the stator having a stator cavity having converging opposed stator surfaces defining a 30° chamfer angle at the opening defined thereby, and with said armature being wedge shaped and having converging armature surfaces positioned for parallel engagement with said converging opposed stator surfaces.

7. A manually operable power unit for paint scraping and the like comprising a casing having a handle to enable portable use by an operator, an electro-magnetic motor mounted within the casing including a C-shaped stator and an armature coaxially mounted relative to said C-shaped stator, the C-shaped stator a series of parallel stator laminations aligned front to back of the C-shaped stator, the armature having parallel armature laminations stacked back to back, a bladeholder connected to said armature reciprocally movable in unison together, means for mounting the bladeholder generally coaxially of the longitudinal axis of the reciprocating armature to provide contemporaneous colinear movement of the bladeholder and the armature to substantially eliminate bending forces on the bladeholder imposed by the electromagnetic drive forces of the motor, the motor being operable on energization to move the armature and the bladeholder from a starting position to an extended position, and spring means connected at one end to the bladeholder and at an opposite end to the casing, the spring means being operable to move the bladeholder from its extended position to its starting position upon release of the electromagnetic forces generated by the motor.

8. The power unit of claim 7 further characterized by the C-shaped stator having an opening at its rear end defined by a 30° chamfer angle at the opening, the opening being further defined by converging opposed stator surfaces, the armature laminations being defined at front ends by converging armature surfaces at front ends mating with the converging opposed stator surfaces having the 30° chamfer angle.

9. The power unit of claim 7 further characterized by the casing being comprised of a pair of molded plastic shell halves substantially enclosing the periphery of the stator assembly and the coil except at the top and bottom of the coil and further enclosing the bladeholder at the forward end of the casing, the casing further enclosing said spring means and having a rearward opening, a hand operated adjustment knob extended into the rear opening and providing means for varying the rearward extent of movement of the bladeholder.

10. The power unit of claim 7 further characterized by the casing having a curved bottom surface underlying the bladeholder to permit the casing to be engaged upon a surface to be scraped in various adjusted positions in accordance with the requirements of the user.

11. A drive assembly for a power scraper comprising an electromotor having relatively movable stator and armature assemblies, the stator assembly having a front and a rear and being formed of stacked laminations of generally C-shape having an opening at the throat of the C lying adjacent the rear of the stator assembly, the throat opening of the stator assembly being chamfered having a larger dimension on the outside of the stator assembly and a smaller dimension on the inside of the stator assembly, said armature assembly formed of a stack of laiminations having top and bottom faces angled complementary to the chamfer of the stator assembly, the armature assembly positioned adjacent the throat opening of the stator assembly and reciprocable between positions substantially within the throat opening and substantially outside of the throat opening, the stator, and a blade holder extending from said armature through said scraper and projecting therefrom with a paint scraper blade affixed to the bladeholder for movement therewith.

12. The device of claim 11 including means affixed to the armature assembly extending forward of the stator on the side of the stator opposite the throat opening and return spring means positioned forward of the stator engaging the means affixed to the armature biasing the armature away from the stator throat opening.

13. A device according to claim 12 wherein the armature assembly includes bumper means resisting impact collision between the armature and stator laminations.

14. A device according to claim 13 wherein the stator is substantially encased in a casing having a recess therein for receipt of the spring means for biasing the armature.

15. A power paint scraper commprising a housing having a bottom surface, a top rearwardly located handle portion, a front end, a rear end, a rear-to-front longitudinal axis and a top face extending from adjacent the front end rearwardly to the handle portion, an electric motor contained within the housing and having an armature movable parallel to said longitudinal axis driving a bladeholder connected to the armature for comovement therewith and which projects from the front end beyond the housing, a blade having a scraping edge depending from the bladeholder, the bottom surface having a sloped forward portion having at least a portion thereof having an angle of slope intersecting the path of movement of the blade edge, the motor moving the blade towards and away from the front end along a substantially longitudinal path of movement.

16. A hand-held power scraper comprising:

a housing having a front opening and a longitudinal axis;

a bladeholder disposed in said housing and having a free end extending through said front opening outside of said housing, said bladeholder having a U-shaped cross section;

a blade assembly attached to said free end of said bladeholder;

a frame in said housing having a U-shaped channel in which said bladeholder slides;

a mounting means connecting said frame to said housing;

a drive means including an armature mounted on said frame, said drive means moving said armature parallel to said longitudinal axis, said armature engaging said bladeholder behind said drive means for longitudinally rapidly reciprocating said bladeholder; and a bearing means including at least one felt washer press fit in said housing against said frame and behind said front opening, said bearing means having a U-shaped channel in which said bladeholder slides in registry with said U-shaped channel in said frame, said felt washer providing a seal for said front opening preventing foreign material from entering said housing therethrough.

17. A power scraper as claimed in claim 16 wherein said bladeholder has a generally centrally disposed opening therein for reducing the mass of said bladeholder and thereby reducing the inertia of said bladeholder for easing said rapid reciprocation thereof.

18. A power scraper as claimed in claim 16 wherein said bladeholder has a recess therein, and said power scraper further comprising:

a coil spring received in said recess in said bladeholder, said coil spring having one end abutting said bladeholder and an opposite end abutting said frame for opposing motion of said bladeholder imparted thereto by said armature.

19. A power scraper as claimed in claim 16 wherein said housing consists of joined symmetric shells each having a pair of spaced receptacles therein, and further comprising:

a pair of parallel rods extending through said frame transversely to the direction of reciprocation of said bladeholder, each of said rods having opposite free ends; and pairs of bosses on opposite sides of said frame through which said free ends of said rods extend, and grommets respectively received in each of said receptacles in said housing shells, said grommets holding said free ends of said rods in said bosses.

20. A power scraper as claimed in claim 16 wherein said housing consists of joined symmetric shells and wherein said frame and said bearing means are press fit between said housing shells, and press fit comprising the sole connection and support thereof within said housing.

21. A power scraper as claimed in claim 16 wherein said blade assembly comprises:

a blade carrier covering said free end of said bladeholder;

a blade attached to said blade carrier and extending transversely to the direction of reciprocation of said bladeholder;

a clamp covering at least a portion of said blade carrier such that said blade carrier is held between said clamp and said free end of said bladeholder; and a tightenable fastening means extending through said clamp and said bladeholder for tightly holding said clamp to said bladeholder with said blade carrier therebetween.

22. A power scraper as claimed in claim 21 wherein said bladeholder has a pair of spaced recesses therein and wherein said clamp has a pair of rearwardly disposed spaced tabs therein received in said recesses for further retaining said clamp against said bladeholder.

23. A power scraper as claimed in claim 16 wherein said housing consists of joined symmetric shells and wherein said housing shells each have a shoulder assembly disposed therein spaced from said front opening, and wherein said bearing means comprises:

a first bearing element having a U-shaped channel in registry with said U-shaped channel in said frame through which said bladeholder slides, said first bearing element having a flange; and a second bearing element having a recess therein for receiving said felt washer and having a projection extending into said front opening, said second bearing element also having a U-shaped channel in registry with said U-shaped channel in said frame and said first bearing element through which said bladeholder slides, said flanges of said first bearing element and said second bearing element being press fit between said front opening and said shoulder assembly of said housing with said felt washer press fit therebetween.

24. A power scraper as claimed in claim 16 wherein said bladeholder has a rear recess and wherein said armature has a free end extending into said recess and engaging a front edge thereof for reciprocating said bladeholder upon actuation of said armature.

25. A power scraper as claimed in claim 24 wherein said front edge of said rear recess in said bladeholder is covered with a pad having a curved surface, and wherein said free end of said armature has a complementary curved surface receiving said pad in sliding relationship.

26. A power scraper as claimed in claim 24 wherein said rear recess of said bladeholder has a rear edge, and further comprising a rectangular pad covering said rear edge of said recess in said bladeholder.

27. A power scraper as claimed in claim 16 further comprising:

a front bumper mounted on said frame adjacent said armature for limiting and cushioning movement of said armature upon actuation thereof.

28. A power scraper as claimed in claim 16 further comprising a stroke limiting means mounted on said frame behind said armature for limiting movement of said armature after actuation thereof.

29. A power scraper as claimed in claim 28 wherein said stroke limiting means comprises:

upper and lower clamps defining a circular threaded receptacle therebetween;

a threaded bumper comprised of resilient material received in said threaded opening between said clamps, said bumper being rotatable therein for adjusting the axial position thereof with respect to said armature; and a tightenable fastener extending through said upper and lower clamps for tightening said clamps around said bumper after adjusting the axial position of said bumper.

30. A hand-held power scraper comprising:

a housing having a front opening;

a bladeholder disposed in said housing and having a free end extending through said front opening outside of said housing, said bladeholder having a U-shaped cross section and having a rear recess, a centrally disposed recess for reducing the mass of said bladeholder, and a forward recess;

a blade assembly carried on said free end of said bladeholder;

a frame in said housing having a U-shaped channel in which said bladeholder slides;

a pair of rods extending transversely through said frame, each of said rods having free ends extending through respective bosses on opposite sides of said frame, said bosses being received in respective receptacles in said housing;

a coil spring received in said forward recess in said bladeholder, said coil spring having a first end abutting said bladeholder and a second opposite end abutting said frame for normally urging said bladeholder toward a rear of said scraper;

a drive means including an armature, said armature having a free end extending into said rearward recess of said bladeholder, said armature upon actuation thereof by said drive means moving said bladeholder toward a front of said scraper, said armature and said coil spring in combination rapidly laterally reciprocating said bladeholder; and a bearing means including at least one felt washer press fit in said housing against said frame and behind said front housing opening, said bearing means having a U-shaped channel in registry with said U-shaped channel in said frame through which said bladeholder slides, said felt washer providing a seal for said front opening preventing foreign material from entering said housing therethrough.

31. A power scraper as claimed in claim 30 wherein said housing consists of symmetric joined shells and wherein said housing shells each have a shoulder assembly disposed therein spaced from said front opening, and wherein said bearing means comprises:

a first bearing element having a U-shaped channel in registry with said U-shaped channel in said frame through which said bladeholder slides, said first bearing element having a flange; and a second bearing element having a recess therein for receiving said felt washer and having a projection extending into said front opening, said second bearing element also having a U-shaped channel in registry with said U-shaped channel in said frame and said first bearing element through which said bladeholder slides, said flange of said first bearing element and said second bearing element being press fit between said front opening and said shoulder assembly of said housing with said felt washer press fit therebetween.

32. A power scraper as claimed in claim 30 further comprising a stroke limiting means mounted on said frame behind said armature for limiting movement of said armature after actuation thereof.

33. A power scraper as claimed in claim 30 wherein said stroke limiting means comprises:

upper and lower clamps defining a circular threaded receptacle therebetween;

a threaded bumper comprised of resilient material received in said threaded opening between said clamps, said bumper being rotatable therein for adjusting the axial position thereof with respect to said armature; and a tightenable fastener extending through said upper and lower clamps for tightening said clamps around said bumper after adjusting the axial position of said bumper.

34. A power scraper as claimed in claim 30 wherein said blade assembly comprises:

a blade carrier covering said free end of said bladeholder;

a blade attached to said blade carrier and extending transversely to the direction of reciprocation of said bladeholder;

a clamp covering at least a portion of said blade carrier such that said blade carrier is held between said clamp and said free end of said bladeholder; and a tightenable fastening means extending through said clamp and said bladeholder for tightly holding said clamp to said bladeholder with said blade carrier therebetween.

35. A power scraper as claimed in claim 34 wherein said bladeholder has a pair of spaced recesses therein and wherein said clamp has a pair of rearwardly disposed spaced tabs therein received in said recesses for further retaining said clamp against said bladeholder.

36. A scraper tool comprising:

a housing having a front end, rear end and a longitudinal axis extending therebetween, and having a front opening;

an electric motor disposed in said housing having a stator and an associated armature, said armature being moved in a direction parallel to said longitudinal axis upon energization of said motor;

a bladeholder having a proximal end disposed behind said stator and connected to said armature for comovement therewith parallel to said longitudinal axis, a distal end projecting out of said housing front opening, and a central portion in said housing having a recess therein;

a spring disposed in said recess connected to said bladeholder and to said housing opposing movement of said bladeholer by said armature;

means for mounting said bladeholder in said housing permitting reciprocating sliding movement thereof parallel to said longitudinal axis;

a scraper blade; and means for mounting said scraper blade to said distal end of said bladeholder.

37. A scraper tool as claimed in claim 36 further comprising means for pivotally mounting said armature with respect to said stator.

38. A scraper tool as claimed in claim 37 wherein said means for pivotally mounting said armature with respect to said stator is further defined as a means for pivotally mounting said armature with respect to said stator with said armature extending generally perpendicular to said bladeholder.

39. A scraper tool as claimed in claim 36 further comprising means for rigidly mounting said armature co-linear with said bladeholder.

* * * * *